US008132629B2

(12) United States Patent
Reilly et al.

(10) Patent No.: US 8,132,629 B2
(45) **Date of Patent: *Mar. 13, 2012**

(54) METHOD AND APPARATUS FOR DRYING SPRINKLER PIPING NETWORKS

(75) Inventors: William J. Reilly, Langhorne, PA (US); Kevin J. Blease, Easton, PA (US)

(73) Assignee: Victaulic Company, Easton, PA (US)

( * ) Notice: Subject to any disclaimer, the term of this patent is extended or adjusted under 35 U.S.C. 154(b) by 638 days.

This patent is subject to a terminal disclaimer.

(21) Appl. No.: 11/851,782

(22) Filed: Sep. 7, 2007

(65) Prior Publication Data

US 2008/0060215 A1 Mar. 13, 2008

Related U.S. Application Data

(60) Provisional application No. 60/843,816, filed on Sep. 12, 2006.

(51) Int. Cl.

| | |
|---|---|
| ***A62C 35/00*** | (2006.01) |
| ***A62C 2/00*** | (2006.01) |
| ***A62C 3/00*** | (2006.01) |
| ***F26B 5/04*** | (2006.01) |
| ***F26B 3/00*** | (2006.01) |

(52) U.S. Cl. ..... 169/43; 169/16; 169/17; 169/46; 34/413; 34/443

(58) Field of Classification Search ..... 169/16, 169/17, 43, 46; 34/406, 408, 443, 413; 62/89, 62/90, 92, 93; 15/314

See application file for complete search history.

(56) References Cited

U.S. PATENT DOCUMENTS

| | | | | |
|---|---|---|---|---|
| 1,869,203 | A | 7/1932 | Lowe et al. | 169/17 |
| 1,942,822 | A | 1/1934 | Lowe et al. | 169/17 |
| 1,945,284 | A | 1/1934 | Lowe | |
| 2,051,103 | A | 8/1936 | Pohlman | |
| 2,187,906 | A * | 1/1940 | Lowe | 169/17 |
| 2,421,303 | A * | 5/1947 | Van Houten | 169/17 |
| 2,699,217 | A * | 1/1955 | Elmenhorst | 169/17 |
| 2,865,457 | A | 12/1958 | Jensen | 169/17 |
| 3,516,455 | A | 6/1970 | Carter | |

(Continued)

FOREIGN PATENT DOCUMENTS

| | | |
|---|---|---|
| GB | 327436 | 4/1930 |

(Continued)

OTHER PUBLICATIONS

U.S. Appl. No. 11/851,816, filed Sep. 7, 2007, "Method and Apparatus for Drying Sprinkler Piping Networks" (Reilly et al).

*Primary Examiner* — Len Tran
*Assistant Examiner* — Ryan Reis
(74) *Attorney, Agent, or Firm* — Ballard Spahr LLP

(57) ABSTRACT

A sprinkler system and a method for mitigating scaling, microbiological influenced corrosion and oxidative corrosion are disclosed. The system includes a piping network in fluid communication with a source of pressurized water and an air pump. The network is vented to the ambient. The air pump moves initially dry ambient air through the system, either by maintaining a negative or a positive air pressure within the network. The dry air absorbs residual water within the network and exhausts it to the ambient. Rate of air flow through the system is controlled by restrictor elements such as orifices, throttle valves or venturies within the piping network.

22 Claims, 2 Drawing Sheets

U.S. PATENT DOCUMENTS

| | | | | | |
|---|---|---|---|---|---|
| 3,602,938 | A | * | 9/1971 | Lindsay | 15/314 |
| 3,759,331 | A | * | 9/1973 | Livingston | 169/17 |
| 4,428,085 | A | | 1/1984 | Bateson | |
| 4,987,750 | A | | 1/1991 | Meckler | |
| 4,992,669 | A | | 2/1991 | Parmley | |
| 5,139,044 | A | | 8/1992 | Otten et al. | 137/80 |
| 5,228,469 | A | | 7/1993 | Otten et al. | 137/80 |
| 5,692,571 | A | | 12/1997 | Jackson | 169/16 |
| 5,778,604 | A | | 7/1998 | Snow | |
| 5,927,406 | A | * | 7/1999 | Kadoche | 169/17 |
| 5,971,080 | A | | 10/1999 | Loh et al. | 169/43 |
| 6,112,533 | A | | 9/2000 | Kato | |
| 6,209,654 | B1 | | 4/2001 | Curless | 169/17 |
| 6,415,870 | B1 | | 7/2002 | Matsuoka | 169/16 |
| 6,708,771 | B2 | | 3/2004 | Reilly | 169/16 |
| 6,715,561 | B2 | | 4/2004 | Franson | 169/17 |
| 6,889,912 | B2 | | 5/2005 | Clum et al. | 239/1 |
| 6,960,321 | B1 | | 11/2005 | Ludwig | 422/26 |
| 7,186,059 | B2 | | 3/2007 | Barnes | |
| 7,295,898 | B2 | | 11/2007 | Lovett et al. | |
| 7,370,490 | B2 | | 5/2008 | Li | |
| 2002/0024162 | A1 | | 2/2002 | Maguire | 264/40.7 |
| 2004/0056779 | A1 | | 3/2004 | Rast | |
| 2004/0211092 | A1 | | 10/2004 | Barnes | |
| 2004/0231862 | A1 | | 11/2004 | Kirn et al. | 169/16 |
| 2005/0115722 | A1 | | 6/2005 | Lund et al. | 169/5 |
| 2005/0252664 | A1 | | 11/2005 | Clum et al. | 169/17 |
| 2007/0000274 | A1 | | 1/2007 | Li | |
| 2007/0134067 | A1 | | 6/2007 | Barnes | |
| 2007/0144748 | A1 | | 6/2007 | Clum et al. | 169/17 |
| 2007/0173980 | A1 | | 7/2007 | Lovett et al. | |
| 2008/0060215 | A1 | | 3/2008 | Reilly et al. | |
| 2008/0060216 | A1 | | 3/2008 | Reilly et al. | |
| 2009/0107056 | A1 | | 4/2009 | Kirilichin et al. | |

FOREIGN PATENT DOCUMENTS

| | | |
|---|---|---|
| WO | WO2005/110550 | 11/2005 |

* cited by examiner

METHOD AND APPARATUS FOR DRYING SPRINKLER PIPING NETWORKS

CROSS-REFERENCE TO RELATED APPLICATION

This application is based on and claims priority to U.S. Provisional Application No. 60/843,816, filed Sep. 12, 2006.

FIELD OF THE INVENTION

This invention relates to a fire suppression sprinkler system having a piping network that is dried to mitigate the adverse effects of scaling, oxidative corrosion and microbiologically influenced corrosion.

BACKGROUND OF THE INVENTION

Microbiological influenced corrosion (MIC) can lead to significant problems in piping networks of fire suppression systems. Water borne microbiological entities, such as bacteria, molds and fungi, brought into a piping network of a sprinkler system with untreated water, feed on nutrients within the piping system and establish colonies in the stagnant water within the system. This occurs even in so-called "dry" sprinkler systems where significant amounts of residual water may be present in the piping network after a test or activation of the system.

Over time, the biological activities of these living entities cause significant problems within the piping network. Both copper and steel pipes may suffer pitting corrosion leading to pin-hole leaks. Iron oxidizing bacteria form tubercles, which are corrosion deposits on the inside walls of the pipes that can grow to occlude the pipes. Tubercles may also break free from the pipe wall and lodge in sprinkler heads, thereby blocking the flow of water from the head either partially or entirely. Even stainless steel is not immune to the adverse effects of MIC, as certain sulfate-reducing bacteria are known to be responsible for rapid pitting and through-wall penetration of stainless steel pipes.

In addition to MIC, other forms of corrosion are also of concern. For example, the presence of water and oxygen within the piping network can lead to oxidative corrosion of ferrous materials. Such corrosion can cause leaks as well as foul the network and sprinkler heads with rust particles. The presence of water in the piping network having a high mineral content can cause scaling as the various dissolved minerals, such as calcium and zinc, react with the water and the pipes to form mineral deposits on the inside walls which can inhibit flow or break free and clog sprinkler heads, preventing proper discharge in the event of a fire.

There is clearly a need for a piping network for sprinkler systems wherein scaling, oxidative corrosion and MIC is mitigated so as to be insignificant.

SUMMARY OF THE INVENTION

The invention concerns a dry type fire suppression sprinkler system wherein MIC, other forms of corrosion, and scaling is mitigated. The system comprises a plurality of sprinkler heads, a source of pressurized water and a piping network connecting the sprinkler heads to the water source. Because it is a dry type system, the piping network is normally substantially devoid of water, i.e., when not responding to a fire. A supply valve is positioned in the piping network between the source of pressurized water and the sprinkler heads and controls the flow of water thereto. The supply valve is openable in the event of a fire to allow water to flow to the heads. An air vent is positioned in the piping network downstream of at least a portion of the sprinkler heads which provides fluid communication between the piping network and ambient air. An air pump is in fluid communication with the piping network between the valve and the sprinkler heads. The air pump moves ambient air through at least a portion of the piping network through the air vent.

In one embodiment, the air pump comprises a vacuum pump adapted to draw ambient air into the piping network through the air vent and exhaust the ambient air back to the atmosphere. The embodiment further comprises a flow restrictor positioned within the piping network between the air vent and the vacuum pump for controlling the rate of air flow through the piping network. The flow restrictor may comprise an orifice, a throttle valve, a venture or other device which restricts fluid flow. The flow restrictor may comprise the air vent.

The sprinkler system may further comprise a dryer positioned within the piping network between the air vent and the vacuum pump. The dryer removes moisture from air drawn through the air vent by the vacuum pump. The dryer may comprise a device such as a desiccant dryer, a refrigeration dryer, a membrane filter a compressed air dryer, or other drying apparatus.

In another embodiment, the system comprises a source of pressurized water and a piping network comprising at least one branch, but preferably a plurality of branches. Because the system is a dry type system, the piping network is normally substantially devoid of water, i.e., when not responding to a fire. The branch is in fluid communication with the source of pressurized water. A supply valve is positioned in the piping network between the source of pressurized water and the branch and controls flow of water thereto. The supply valve is openable in the event of a fire to allow water to flow to the branch. A plurality of sprinkler heads are mounted on the branch. An air vent is positioned at an end of the branch and provides fluid communication between the branch and the ambient air. A vacuum pump is in fluid communication with the piping network between the valve and the branch. The vacuum pump draws ambient air through the one branch through the air vent.

The system may also comprise an orifice positioned within the branch for controlling the rate of air flow therethrough. The orifice may comprises the air vent. Alternately, a throttle valve is positioned within the branch, the throttle valve being adjustable for controlling the rate of air flow through the one branch. The throttle valve may comprise the air vent.

The system may also include a dryer positioned within the branch between the air vent and the sprinkler heads. The dryer removes moisture from air drawn through the air vent by the vacuum pump. The dryer may comprise, for example a desiccant dryer, a refrigeration dryer, a membrane filter, a compressed air dryer or other gas drying apparatus.

In another embodiment of a dry type sprinkler system according to the invention the air pump comprises a compressor adapted to force ambient air into the piping network. The ambient air is exhausted back to the atmosphere through the air vent. The system may also comprise a flow restrictor positioned within the piping network between the air vent and the compressor for controlling the rate of air flow through the piping network. The flow restrictor may be an orifice, a throttle valve or a venturi.

The system may also include a dryer positioned within an air flow of the compressor. The dryer removes moisture from air forced into the piping network. Preferably the dryer is positioned within the piping network between the compressor and the air vent. The dryer may comprises a desiccant dryer, a refrigeration dryer, a membrane filter or a compressed air dryer.

The invention also encompasses a method of drying a piping network. The method comprises:

(a) providing an air vent in the piping network;

(b) moving air from the ambient, through the piping network; and (c) exhausting the air back to the ambient.

In one aspect of the method, moving air through the piping network comprises drawing the air into the piping network through the air vent. In another aspect of the invention, moving air through the piping network comprises compressing the air into the piping network and exhausting the air back to the ambient comprises venting the air to the atmosphere through the air vent. The method may also include controlling the rate at which air moves through the piping network by restricting the flow. The method may also include drying the air before it is moved through the piping network.

DETAILED DESCRIPTION OF THE EMBODIMENTS

Figure 1:
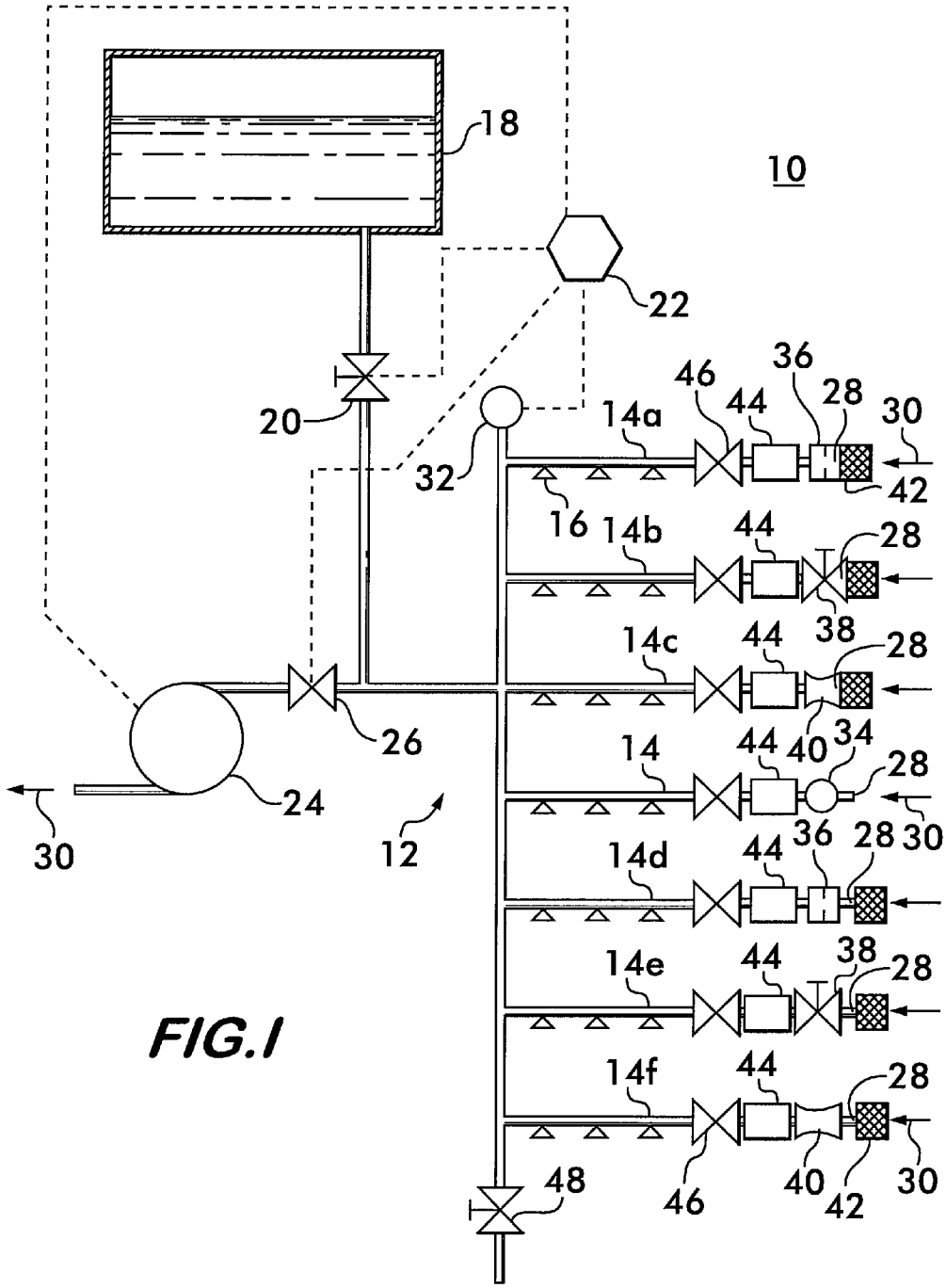
FIGS. 1 and 2 are schematic diagrams of exemplary embodiments of dry type fire suppression sprinkler systems according to the invention.

FIG. 1 shows a schematic diagram of a dry type fire suppression sprinkler system 10 according to the invention. System 10 comprises a piping network 12 formed of a plurality of branches 14 on which are mounted a plurality of sprinkler heads 16. Because it is a dry type system, the piping network, including the branches, is normally substantially devoid of water when not responding to a fire. The branches 14 with their sprinkler heads 16 extend throughout a building, such as a residence, an apartment, an office complex, a warehouse or other structure to be protected. Sprinkler heads 16 may have one of various types of triggering mechanisms which open the heads in response to a fire condition to allow the discharge of water. The well known glass bulb containing a heat sensitive liquid is one example of a triggering mechanism. Other examples include collapsing mechanisms held together by a eutectic solder.

The piping network 12 connects the sprinkler heads 16 to a source of pressurized water 18, which could be, for example, a municipal water main, or a reservoir. Water flow from the source to the sprinkler heads 16 is controlled by a supply valve 20 positioned in the network 12 between the water source 18 and the various branches 14, 14*a*-14*f* of the piping network on which the heads 16 are mounted. As noted, the system shown is a dry type system wherein the piping network downstream of supply valve 20 is not charged with water in its ready state. However, there may still be residual stagnant water in the piping network, for example, water remaining due to incomplete draining after a test of the system or a previous actuation.

Supply valve 20 is actuated by a control system 22, for example, a programmable logic controller or a microprocessor with resident software. The control system may also include a pressure sensitive actuator (with or without an accelerator mechanism) that is in communication with the piping network, one or more heat sensitive actuators, radiation sensitive actuators, smoke sensitive actuators or other actuators that are capable of detecting a fire condition and providing a signal to the control system causing it to open the main valve and allow water to flow to the sprinkler heads.

An air pump 24 is in fluid communication with the piping network 12 between the supply valve 20 and the sprinkler heads 16. In the embodiment shown in FIG. 1, the air pump 24 is a vacuum pump which draws ambient air through the piping network while the system 10 is in a "ready" state (i.e., ready for actuation in the event of a fire) as described below. Preferably, the pump 24 is a rocking piston type vacuum pump which operates over a short duty cycle to ensure long pump life. Pump 24 is protected by a cut-off valve 26 which is open when the system is in the ready state. When the system is actuated and the supply valve 20 is opened, the cut-off valve 26 is closed, for example, by the control system 22, to prevent water from being drawn into the pump.

Various branches 14 of the piping network may have an air vent 28, preferably positioned downstream of the last sprinkler head 16 in the branch. The air vents allow ambient air 30 to be drawn into the piping network through the branches by the vacuum pump 24. Preferably the air vents provide continuous fluid communication between the piping network and the ambient when the system is in the ready state. The air flow may be substantially continuous through the branches with the pump 24 operating intermittently to maintain a negative pressure between a predetermined minimum and maximum within the piping network. Negative pressure may be maintained within the system 10 through the use of a simple feed back loop which comprises a pressure sensor 32 which senses the gas pressure within the piping network 12 and returns a signal to the control system 22, which cycles the vacuum pump 24 on and off as needed to maintain the desired pressure. Air 30, drawn through the network, is exhausted to the atmosphere by the vacuum pump.

Air flow through each branch 14 is controlled by a flow restrictor 34 depicted schematically in branch 14. Various types of restrictors may be employed, such as an orifice 36 shown in branch 14*a*, a throttle valve 38 in branch 14*b*, as well as a venturi 40, shown in branch 14*c*. Other types of flow restrictors are also feasible. The restrictors may be all of the same type, or mixed types may be used in a single system. The flow characteristics of the flow restrictors may be varied to balance the air flow through the various branches. Thus, the sizes of the orifices 36 may be different in different branches depending upon their length and distance from the vacuum pump 24, with longer branches and more distant branches having larger orifices than shorter, closer branches to compensate for the greater resistance to flow through the longer or more distant branch. Similarly, throttle valves may be adjusted individually as required to different opening sizes to balance the flow for a particular negative pressure.

In branches 14*a*-14*c*, the flow restrictors 36, 38 and 40 also comprise the air vents 28. Alternately, as depicted in branches 14*d*-14*f*, the flow restrictors 36, 38 and 40 are positioned within the piping network 12 in spaced relation away from the air vents 28. Filters 42 may be used in conjunction with the air vents 28 to filter particulates from the air 30 to prevent clogging of the various flow restrictors.

An air dryer 44 may be positioned between each air vent 28 and the last sprinkler head 16 in each branch of the piping network 12. Desiccant dryers, which absorb water using granular material such as activated alumina or silica gel, are particularly advantageous because they are effective, inexpensive, compact and require little maintenance. Other drying devices, such as refrigeration dryers, membrane filters and compressed air dryers, are also feasible. Each dryer 44 is protected from water in the branch by a check valve 46 positioned in the branch between the dryer and the last sprinkler head. The check valves 46 are arranged to permit flow of air 30 from the air vent 28 to the vacuum pump 24, but prevent water flow from the water source 18 to the dryers 44.

In operation, the fire suppression sprinkler system 10 may be activated, for example, in a test or in an actual fire event. The control system 22 opens supply valve 20, supplying water to the network 12 and its various branches 14. In a fire event, one or more sprinkler heads 16 in the vicinity of the fire will trigger, allowing water to be discharged to suppress the fire. The check valves 46 prevent water from entering the dryers 44 and exiting the system through air vents 28. The control system also closes cut-off valve 26, protecting vacuum pump 24.

Upon completion of the fire or test event, the supply valve 20 is closed and a drain valve 48 is opened to drain the piping network 12 so that it is substantially devoid of water as appropriate for a dry type system in the absence of a fire. Any sprinkler heads 16 that opened during the fire are replaced, and the cut-off valve 26 is then opened. The system 10 is again reset in the ready state, capable of detecting a fire and operating to suppress it. It is expected, however, that despite draining the system, residual water will remain in the piping network 12, for example, in any or all of the branches 14. The water may remain stagnant within the pipes for long periods of time between system actuations, providing ample opportunity for microbiological influenced corrosion, oxidative corrosion and scaling to damage the pipes and cause leaks or blockages. To mitigate this damage, the vacuum pump 28 is run intermittently to maintain a negative pressure within the piping network. This causes air 30 to be drawn into the branches through air vents 28. The flow rate is determined largely by the flow restrictors 34, such as the orifices 36, the throttling valves 38 and the venturis 40 in each branch in conjunction with the negative system pressure. The flow rate is established to ensure an adequate, substantially continuous air flow throughout the system capable of removing the residual water while operating within reasonable parameters for the duty cycle of the vacuum pump. For large systems multiple vacuum pumps 24 may be employed.

Moisture is removed from the ambient air 30 drawn into the piping network through air vents 28 as it passes through the dryers 44. The incoming air is dried to a predetermined dew point and then continues on through the piping network 12, whereupon it is exhausted to the atmosphere by the vacuum pump 24. As it travels through the various branches of the network, the dry air absorbs the residual water that would otherwise stagnate within the pipes. The continuous flow of initially dry air gradually removes the water from the piping network, starving the microbiological entities of the water they need to survive, and effectively curtailing microbiologically influenced corrosion damage. Other forms of corrosion, such as oxidative corrosion as well as scaling effects, are also significantly inhibited by removal of the water. In dry climates where the ambient air has low relative humidity it may be possible to dispense with the dryers. Similarly, for large systems formed of pipes having relatively small diameters, discrete flow restrictors may not be necessary, as the lengths and diameter of the pipes themselves may provide the desired air flow rates for effective drying.

Figure 2:
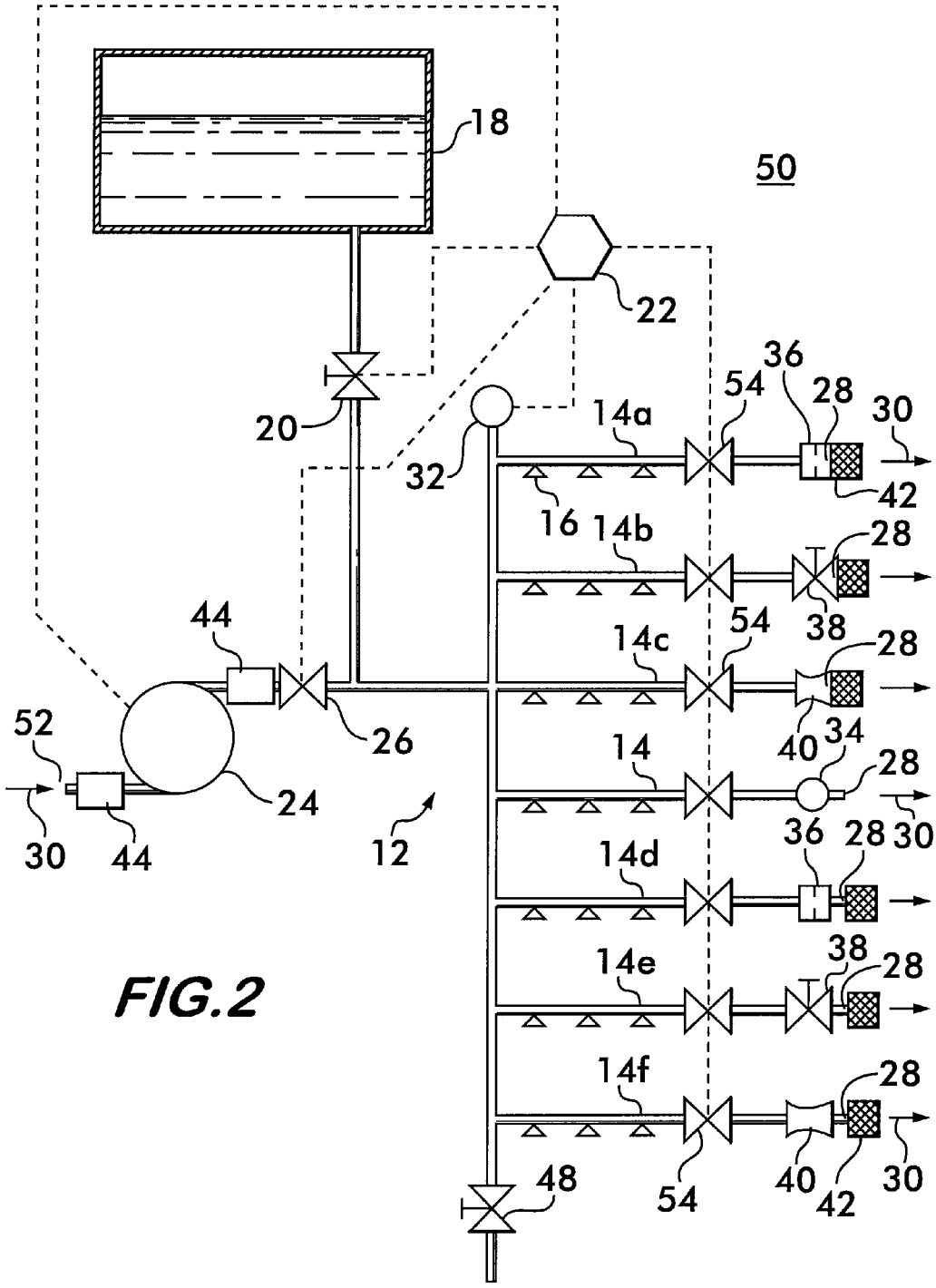

In another system embodiment 50, shown in FIG. 2, the air pump 24 is a compressor which forces ambient air 30 into the piping network 12. Air 30 passes through a dryer 44, positioned either at the intake 52 of the compressor or between the compressor and the cut-off valve 26, where the moisture is removed. The dry air then passes through the various piping network branches 14, absorbing the residual water and exiting each branch at an air vent 28. The compressor 24 is operated intermittently in a feed back control loop by the control system 22 which receives signals from the pressure sensor 32 and operates the compressor to maintain the piping network at a positive pressure between an upper and a lower limit. The rate of air flow through the system is controlled largely by the flow restrictors 34 as described above, in conjunction with the system pressure. Valves 54, under the control of the control system 22 are advantageously positioned between the last sprinkler head 16 in each branch and the air vents 28, and are closed by the control system when the sprinkler system is activated to suppress a fire, thereby preventing water from exiting through the air vents.

The sprinkler system according to the invention is advantageously used with dry systems, but will also find use with wet systems that are seasonally converted to dry systems as, for example, in an unheated warehouse where the sprinkler system is operated as a wet system in the summer and as a dry system in the winter.

What is claimed is:

1. A dry type fire suppression sprinkler system comprising:

a plurality of sprinkler heads being in a dosed configuration, said sprinkler heads being openable in response to a fire;

a source of pressurized water;

a piping network connecting said sprinkler heads to said source of pressurized water, said piping network being normally substantially devoid of water;

a supply valve positioned in said piping network between said source of pressurized water and said sprinkler heads and controlling flow of water thereto, said supply valve being openable in the event of a fire allowing water to flow to said heads;

an air pump in fluid communication with said piping network between said supply valve and said sprinkler heads;

an air vent, separate from said air pump, said air vent being positioned in said piping network and providing fluid communication between said piping network and ambient air while said sprinkler heads are in said closed configuration; and said air pump for moving ambient air through at least a portion of said piping network through said air vent while said sprinkler heads are in said closed configuration.

2. A sprinkler system according to claim 1, wherein said air pump comprises a vacuum pump adapted to draw ambient air into said piping network through said air vent and exhaust said ambient air back to the atmosphere while said sprinkler heads are in said closed configuration.

3. A sprinkler system according to claim 2, further comprising a flow restrictor positioned within said piping network between said air vent and said vacuum pump for controlling the rate of air flow through said piping network.

4. A sprinkler system according to claim 3, wherein said flow restrictor comprises an orifice.

5. A sprinkler system according to claim 3, wherein said flow restrictor comprises a throttle valve.

6. A sprinkler system according to claim 3, wherein said flow restrictor comprises a venturi.

7. A sprinkler system according to claim 2, further comprising an orifice for controlling the rate of air flow through said piping network, said orifice comprising said air vent.

8. A sprinkler system according to claim 2, further comprising a throttle valve for controlling the rate of air flow through said piping network, said throttle valve comprising said air vent.

9. A sprinkler system according to claim 2, further comprising a venturi for controlling the rate of air flow through said piping network, said venturi comprising said air vent.

10. A sprinkler system according to claim 2, further comprising a dryer positioned within said piping network between said air vent and said vacuum pump, said dryer removing moisture from air drawn through said air vent by said vacuum pump.

11. A sprinkler system according to claim 10, wherein said dryer comprises a device selected from the group consisting of a desiccant dryer, a refrigeration dryer, a membrane filter and a compressed air dryer.

12. A dry type fire suppression sprinkler system comprising:

a source of pressurized water;

a piping network comprising at least one branch, said one branch being in fluid communication with said source of pressurized water, said piping network being normally substantially devoid of water;

a supply valve positioned in said piping network between said source of pressurized water and said one branch and controlling flow of water thereto, said supply valve being openable in the event of a fire allowing water to flow to said one branch;

a plurality of sprinkler heads mounted on said one branch said sprinkler heads being in a closed configuration and being openable in response to a fire;

a vacuum pump in fluid communication with said piping network between said supply valve and said one branch;

an air vent, separate from said vacuum pump, said air vent being positioned at an end of said one branch and providing fluid communication between said one branch and ambient air while said sprinkler heads are in said closed configuration; and said vacuum pump for drawing ambient air through said one branch through said air vent while said sprinkler heads are in said closed configuration.

13. A sprinkler system according to claim 12, wherein said piping network is comprised of a plurality of said branches, said branches being in fluid communication with said source of pressurized water, said supply valve being positioned between said source of pressurized water and said branches, a plurality of said sprinkler heads mounted on said branches, one of said air vents being positioned at an end of each of said branches, said vacuum pump being in fluid communication with said piping network between said supply valve and said branches, said vacuum pump for drawing ambient air through said branches through said air vents while said sprinkler heads are in said closed configuration.

14. A sprinkler system according to claim 12, further comprising an orifice positioned within said one branch for controlling the rate of air flow therethrough.

15. A sprinkler system according to claim 14, wherein said orifice comprises said air vent.

16. A sprinkler system according to claim 12, further comprising a throttle valve positioned within said one branch, said throttle valve being adjustable for controlling the rate of air flow through said one branch.

17. A sprinkler system according to claim 16, wherein said throttle valve comprises said air vent.

18. A sprinkler system according to claim 12, further comprising a dryer positioned within said one branch between said air vent and said sprinkler heads, said dryer removing moisture from air drawn through said air vent by said vacuum pump.

19. A sprinkler system according to claim 18, wherein said dryer comprises a device selected from the group consisting of a desiccant dryer, a refrigeration dryer, a membrane filter and a compressed air dryer.

20. A method of drying a piping network having a plurality of sprinkler heads, each being in a closed configuration, said method comprising:

providing an air vent in said piping network;

drawing air from the ambient into the piping network through the air vent while said sprinkler heads are in said closed configuration; and exhausting said air back to the ambient.

21. A method according to claim 20, further comprising controlling the rate at which said air moves through piping network by restricting the flow of air therethrough.

22. A method according to claim 20, further comprising drying said air before moving said air through said piping network.

* * * * *

UNITED STATES PATENT AND TRADEMARK OFFICE

CERTIFICATE OF CORRECTION

PATENT NO. : 8,132,629 B2
APPLICATION NO. : 11/851782
DATED : March 13, 2012
INVENTOR(S) : William J. Reilly et al.

It is certified that error appears in the above-identified patent and that said Letters Patent is hereby corrected as shown below:

Column 6, Claim 1, line 22, reads "...in a dosed configuration..."; which should be deleted and replaced with "in a closed configuration..."

Signed and Sealed this
Twelfth Day of June, 2012

David J. Kappos

David J. Kappos
*Director of the United States Patent and Trademark Office*